United States Patent [19]

Colato

[11] Patent Number: 4,717,802

[45] Date of Patent: Jan. 5, 1988

[54] MICROWAVE OVEN ROTISSERIE ASSEMBLY

[75] Inventor: Albert E. Colato, Woodbury, Minn.

[73] Assignee: Plastics, Inc., St. Paul, Minn.

[21] Appl. No.: 47,013

[22] Filed: Jun. 11, 1979

[51] Int. Cl.[4] ..... H05B 6/78

[52] U.S. Cl. ..... 219/10.55 E; 219/10.55 F; 219/389; 99/421 HV; 126/41 A

[58] Field of Search ..... 219/10.55 E, 10.55 F, 219/10.55 R, 10.55 M, 389, 392; 99/419, 421 H, 421 HH, 421 HV, 421 P; 126/41 R, 41 A, 41 B

[56] References Cited

U.S. PATENT DOCUMENTS

| | | | |
|---|---|---|---|
| 1,838,545 | 12/1931 | Guffey | 99/421 P |
| 2,040,016 | 5/1936 | Sanders | 99/421 P |
| 3,333,531 | 8/1967 | Reuther | 99/419 X |
| 3,676,058 | 7/1972 | Gray | 219/10.55 R X |
| 3,744,403 | 7/1973 | Castronuovo | 219/389 X |
| 3,857,009 | 12/1974 | MacMaster et al. | 219/10.55 E |
| 4,061,083 | 12/1977 | Caliva | 99/421 H |
| 4,112,832 | 9/1978 | Severdia et al. | 99/421 HH |
| 4,136,271 | 1/1979 | Tanaka et al. | 219/10.55 F |
| 4,210,794 | 7/1980 | Oguri | 219/10.55 F |
| 4,254,319 | 3/1981 | Beh et al. | 219/10.55 E |
| 4,286,133 | 8/1981 | Einset et al. | 219/10.55 F |
| 4,330,696 | 5/1982 | Pomeroy et al. | 219/10.55 E |

FOREIGN PATENT DOCUMENTS

| | | | |
|---|---|---|---|
| 1092484 | 11/1967 | United Kingdom | 219/10.55 F |

*Primary Examiner*—Philip H. Leung

*Attorney, Agent, or Firm*—Flehr, Hohbach, Test, Albritton & Herbert

[57] ABSTRACT

A portable rotisserie assembly for use in a microwave oven. The assembly comprises a base adapted to rest on a turntable or directly on the floor of the oven cavity, a rotor mounted on the base for rotation about a horizontal axis, and a drive motor mounted on the base.

3 Claims, 3 Drawing Figures

MICROWAVE OVEN ROTISSERIE ASSEMBLY

This invention pertains generally to microwave ovens and more particularly to a rotisserie assembly for use in a microwave oven.

In recent years, microwave ovens have enjoyed increasing popularity due to their ability to cook may foods faster than do conventional ovens, however, is a tendency to produce uneven cooking of foods because of uneven microwave distribution within the oven cavity. Because of this problem, turntables have been employed in some microwave ovens to move the food horizontally while it is being cooked.

Nonuniformities in the microwave energy pattern within the oven cavity occur vertically as well as horizontally, and the vertical nonumiformities can produce uneven cooking at different heights in taller food products, such as a roast, even though a turntable is employed.

It is in general an object of the invention to provide a new and improved rotisserie assembly for rotating foods about a horizontal axis in a microwave oven.

Another object of the invention is to provide a rotisserie assembly of the above character which can be utilized with a turntable to provide both horizontal and vertical movement of the food within the oven cavity.

Another object of the invention is to provide a rotisserie assembly of the above character which can be employed in existing microwave ovens.

These and other objects are achieved in accordance with the invention by providing a portable rotisserie assembly for use with a turntable in a microwave oven. The rotisserie has a base adapted to rest on the platform or table of a turntable or on the floor of the oven cavity in the absence of a turntable. A food-supporting rotor is mounted on the base for rotation about a horizontal axis, the drive means is provided for rotating the rotor about this axis.

Figure 1:
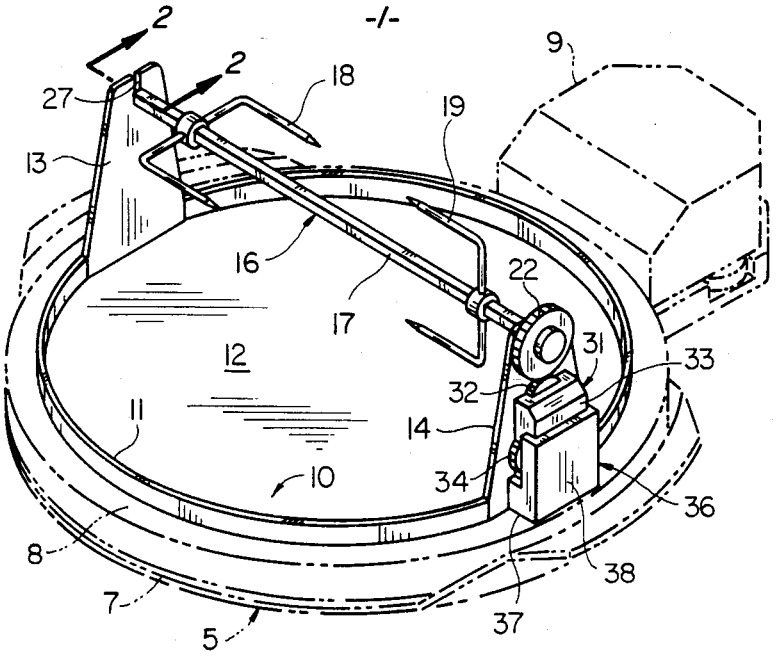
FIG. 1 is a perspective view of one embodiment of a rotisserie assembly incorporating the invention.

In FIG. 1, the rotisserie assembly is illustrated in connection with a turntable 6 which is adapted to be inserted into and removed from the cooking cavity of a microwave oven. The turntable includes a generaly planar base 7 with outwardly projecting handles on opposite sides thereof. A platform or table 8 is rotatively mounted on the base and driven by a drive motor assembly 9 mounted on the base to one side of the table. The motor assembly includes a suitable drive motor such as an electrically powered motor or a spring-powered motor and a suitable transmission or gear train. An output gear of the transmission engages a peripheral ring of gear teeth on the table for rotating the table at a desired speed, e.g., about 0.5–1 rpm.

Base 7 and table 8 are preferably fabricated of a material which is transparent to microwave energy so that they will not interfere with the distribution of microwave energy in the oven cavity. Suitable materials include a modified thermosetting polyester as used in MICROWAVE cookware developed by Plastics, Inc., a subsidiary of Anchor Hocking Corp.; polysulfone; thermoplastic polyesters; polypropylene; polycarbonate; polystyrene; acrylonitrile; butadiene styrene; polyphenylene oxide; acrylic, polyethylene, and other materials.

The drive motor and transmission are enclosed in a housing of metal or other material which is reflective to microwave energy and are thereby shielded from the radiation in the oven cavity. The outer surface of the housing is covered by a layer of electrically insulative material to prevent arcing. The output gear is mounted outside the housing on a shaft which passes through a wall of the housing in a cut-off tube, and an ON/OFF switch accessible externally of the housing controls the operation of the drive motor. A turntable of this general character is described in greater detail in U.S. Pat. No. 4,330,696.

As illustrated in FIG. 1, rotisserie assembly 5 comprises a base 10 having a planar, generally circular base plate 12 with an upstanding peripheral wall or lip 11 and a pair of spaced apart upright arms 13,14 at opposite ends of the base plate. The base is adapted to rest on the table or platform of the turntable, and the entire rotisserie assembly is rotated about a vertical axis by the turntable. Although illustrated in connection with a portable or remote turntable, the rotisserie assembly can also be employed with a turntable which is built into the oven as an integral part thereof, and it can also be used without a turntable, in which case base 10 can rest directly on the floor of the oven cavity.

In the preferred embodiment, base 10 is formed as a unitary structure by a suitable process such as molding, and it is fabricated of a material which is transparent to microwave radiation. One particularly suitable material is a modified thermosetting polyester as used in MICROWAVE cookware developed by the Plastics, Inc. subsidiary of Anchor Hocking Corp. Other suitable materials include polysulfone, thermoplastic polyesters, polypropylene, polycarbonate, polystyrene, aacrylonitrile, butadiene styrene, polyphenylene oxide, acrylic, polyethylene, and other materials, which in some instances may be at least partially reflective to microwaves in order to provide a desired effect such as browning of the food.

A food-supporting rotor 16 is mounted on the base between upright arms 13,14 for rotation about a horizontala axis. In the embodiment of FIG. 1, the rotor comprises a spit having an elongated shaft 17 of generally square cross section with skewers 18,19 slidably mounted thereon. The square cross section is illustrative only, and it will be understood that the shaft can have any other suitable cross section. One end of the spit shaft is pointed, as illustrated at 21, to facilitate insertion into the food to be supported, and a drive gear 22 is affixed to the other end of the shaft. Like the base, the rotor (including drive gear 22) is preferably fabricated of a material which is transparent to microwave radiation, although in some instances it may be desirable to use other materials, e.g., where internal heating of the food or additional stirring or mixing of the microwave energy by the rotor is desired.

Figure 2:
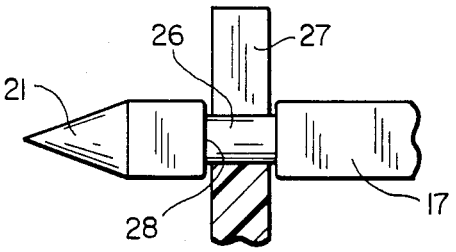
FIG. 2 is an enlarged fragmentary sectional view taken along line 2—2 in FIG. 1.

Toward its ends, shaft 17 is formed to have journals or portions of reduced diameter 26, as best seen in FIG. 2. These journals ar rotatively received in slots 27 formed in upright arms 13,14. The slots extend vertically through the upper side of the upright arms, and the lower walls of the slots are rounded to provide bearing surfaces for the journals. The width of the slots correspond to the diameter of the journals, and radial faces 28 at the ends of the journals prevent undesired axial movement of the rotor. Alternatively, roller bearings or other suitable bearings can be employed in place of the journals and slots.

A drive motor assembly 31 is mounted on the base adjacent to upright arm 14 for rotatively driving the rotor. This motor assembly is similar to motor assembly 9 and includes a drive motor and gear train or transmission, with an output gear 32 in driving engagement with rotor gear 22. the motor and transmission are enclosed within a shielding enclosure or housing 33 which is fabricated of metal or another material reflective to microwave energy. The outer surface of the housing is covered with a layer of electrically insulative material to prevent arcing. Output gear 32 is fabricated of a microwave transparent material and is located outside the shielding enclosure. This gear is connected to the transmission by an output shaft which passes through a cut-off tube to prevent microwave energy from entering the motor housing through the shaft opening. A motor housing of this type is described in greater detail in the aforesaid co-pending application Ser. No. 897,048.

In the preferred embodiment, the drive motor comprises an electrically energized motor powered by one or more rechargeable batteries. Operation of the motor is controlled by an ON/OFF switch 34 which is accessible externally of the motor housing. However, it will be understood that other types of motors and power sources can be employed, if desired. The motor speed and the gear ratio of the transmission are chosen to provide the desired rotor speed, e.g., 2–5 rpm.

In the preferred embodiment, motor assembly 31 is removably mounted on the base in an upright positio adjacent to arm 14. The motor assembly is releasably secured to the upright arm by a mounting bracket 36 comprising a bottom wall 37 and a side wall 38 which, together with the outer portion of the arm, form a pocket for the motor assembly. This mounting bracket constitutes a part of the base and is formed integrally with the remainder of the base. This structure permits the motor assembly to be readily removed and utilized for driving other apparatus such as a turntable.

Operation and use of the rotisserie assembly can now be described. The shaft of the spit is pushed through the food to be cooked, preferably at or near the center of mass of the food, and skewers 18,19 are positioned to hold the food on the spit. The spit is then placed upon the base, with journals 26 being received in slots 27 and drive gear 22 engaging output gear 32 of the motor assembly. The rotisserie assembly is then placed on the platform or table of the turntable, and the drive motors are actuated to rotate food about the horizontally extending axis of the spit while the entire assembly rotates about a vertical axis. As different portions of the food pass through different portions of the microwave pattern, the cooking produced at different horizontal and vertical locations tends to be averaged out, resulting in more uniform cooking of the food. If the rotisserie is used without a turntable, it is placed directly on the floor of the oven cavity, and the rotation of the spit still tends to provide vertical uniformity in the cooking of the food.

Figure 3:
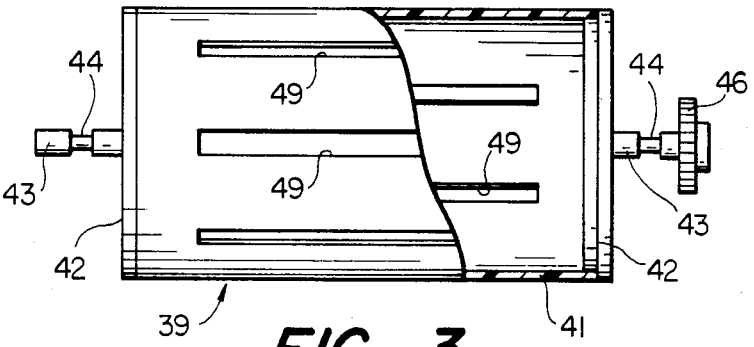
FIG. 3 is a side elevational view, partly broken away, of a second embodiment of a rotor for use in the rotisserie assembly of FIG. 1.

The rotor illustrated in FIG. 3 includes a drumlike container 39 for holding the food to be cooked. This container includes a generally cylindrical side wall 41 with removable end caps 42. Axially extending axles 43 project outwardly from the end caps and include journals 44 which are rotatively received in slots 27 in a manner similar to that of journals 26. A drive gear 46 is affixed to one of the axles for engagement by the output gear of the motor assembly. Container 39, axles 43 and gear 44 are preferably fabricated of a material which is transparent to microwave energy, although other materials can be employed if desired. Suitable materials include those specified above for the base. Longitudinally extending slots 49 are spaced peripherally about the side wall to provide ventillation and permit juices or other liquid to drain from the container.

Operation and use of the rotisserie assembly with the rotor of FIG. 3 is generally similar to that described above. However, the food to be cooked is placed within container 39, and this rotor is mounted on the base in place of spit 16.

It is apparent from the foregoing that a new and improved rotisserie assembly for microwave ovens has been provided. While only certain presently preferred embodiments have been described in detail, as will be apparent to those familiar with the art, certain changes and modifications can be made without departing from the scope of the invention as defined by the following claims.

What is claimed is:

1. In portable apparatus for moving food within the heating cavity of a microwave oven: a base of microwave transparent material resting on a supporting surface in the oven cavity and being freely removable therefrom, a horizontally extending table of microwave transparent material mounted on the base and in close proximity thereto for rotation about a vertically extending axis, a second base of microwave transparent material resting upon the horizontally extending table and being freely removable therefrom, a food-supporting rotor having a horizontally extending axis mounted on the second base and positioned above the table for rotation about the vertically extending axis with said table, and drive means for rotating the table and the rotor about their respective axes whereby food supported by the rotor is turned simultaneously about the vertically extending axis and the horizontally extending axis.

2. In portable apparatus for moving food within the cavity of a microwave oven: a base of microwave transparent material resting on the floor of the oven cavity and being freely removable therefrom, a horizontally extending table of microwave transparent material rotatively mounted on the base for rotation about a vertically extending axis, a first device motor mounted on the base for turning the table about the vertically extending axis, a second base of microwave transparent material resting on the horizontally extending table and being freely removable therefrom, a food supporting rotor having a horizontally extending axis mounted on the second base, and a second drive motor carried by the second base for turning the food supporting rotor about the horizontally extending axis, whereby food supported by the rotor is turned about both the vertically extending axis and the horizontally extending axis.

3. In portable apparatus for moving food within the cavity of a microwave oven: a base of microwave transparent material resting on the floor of the oven cavity and being freely removable therefrom, a horizontally extending table of microwave transparent material rotatively mounted on the base for rotation about a vertically extending axis, a first device motor mounted on the base for turning the table about the vertically extending axis, a second base of microwave transparent material resting on the horizontally extending table and being freely removable therefrom, a food supporting rotor having a horizontally extending axis mounted on the second base, and a second drive motor interchangeable with the first drive motor carried by the second base for turning the food supporting rotor about the horizontally extending axis, whereby food supported by the rotor is turned about both the vertically extending axis and the horizontally extending axis.

* * * * *